US008245328B1

(12) United States Patent
Hir

(10) Patent No.: US 8,245,328 B1
(45) Date of Patent: Aug. 21, 2012

(54) PORTABLE SELF-ATTACHED SANITARY COVER FOR TOILET SEATS

(76) Inventor: Way-Dir Hir, Tainan (TW)

( * ) Notice: Subject to any disclaimer, the term of this patent is extended or adjusted under 35 U.S.C. 154(b) by 0 days.

(21) Appl. No.: 13/367,594

(22) Filed: Feb. 7, 2012

(30) Foreign Application Priority Data

Feb. 14, 2011 (TW) ..... 100202690

(51) Int. Cl.
*A47K 13/14* (2006.01)

(52) U.S. Cl. ..... 4/245.1

(58) Field of Classification Search ..... 4/245.1, 4/245.3, 237
See application file for complete search history.

(56) References Cited

U.S. PATENT DOCUMENTS 1,494,641 A * 5/1924 Sullivan ..... 206/451
1,706,960 A * 3/1929 Kobatake ..... 4/244.3
4,359,787 A * 11/1982 Shoji ..... 4/244.3
5,537,693 A * 7/1996 Dossola et al. ..... 4/245.4
5,790,989 A * 8/1998 Chen ..... 4/245.1
D398,806 S * 9/1998 Thomas ..... D6/611
2011/0271433 A1* 11/2011 Aspiro ..... 4/245.1
* cited by examiner

*Primary Examiner* — Lori Baker
(74) *Attorney, Agent, or Firm* — patenttm.us

(57) ABSTRACT

A portable self-attached sanitary cover for toilet seats is a flexible and annular pad and has an outer edge section, an inner edge section, a seat recess, a weighted section, an excreting hole and a folding gap. The seat recess is formed between the outer edge section and the inner edge section. The weighted section is mounted securely on the outer edge section. The excreting hole is formed through the portable self-attached sanitary cover and is surrounded by the inner edge section. The folding gap is formed in the portable self-attached sanitary cover. Because the portable self-attached sanitary cover has the weighted section, the outer edge section is capable of drooping to tightly abut an outer rim of a toilet seat. Accordingly, the portable self-attached sanitary cover is securely positioned on the toilet seat.

7 Claims, 6 Drawing Sheets

PORTABLE SELF-ATTACHED SANITARY COVER FOR TOILET SEATS

BACKGROUND OF THE INVENTION

1. Field of the Invention

The present invention relates to a portable self-attached sanitary cover for toilet seats, and more particularly to a portable self-attached sanitary cover for toilet seats to droop and tightly abut a toilet seat for positioning.

2. Description of Related Art

With reference to FIG. 11, a toilet seat 90 supports a user, is similar to a saddle and has a shape, a seat hole 91, an outer rim 92 and an inner rim 93. The shape of the toilet seat 90 is similar to an ellipse.

The seat hole 91 is formed through a central area of the toilet seat 90 and has a shape similar to an ellipse.

The outer rim 92 is formed at an outer edge of the toilet seat 90 and has a shape similar to an ellipse.

The inner rim 93 is formed at an inner edge of the toilet seat 90, is surrounded by the outer rim 92 and has a shape similar to an ellipse.

Because the toilet seat 90 in a public toilet is used by many people, the toilet seat 90 is easily contaminated by viruses or bacteria. Consequently, a user may easily get skin diseases or venereal diseases. Therefore, lots of conventional sanitary covers for toilet seats 90 have been invented to prevent the contamination.

Conventional sanitary covers 80 for toilet seats are placed on a top of the toilet seat 90 and are adhered to the toilet seat 90 or have hook sections to attach to the toilet seat 90. However, positioning effect of the conventional sanitary cover is insufficient and the conventional sanitary cover easily slides or falls.

The conventional sanitary cover 80 adhering to the toilet seat 90 has many problems. For example, adhesive mounted on the sanitary cover may lose stickiness. A user may be allergic to the adhesive. The sanitary cover has to be carefully aligned the toilet seat 90 for adherence.

The conventional sanitary cover has hook sections hooking the outer rim 92 and the inner rim 93. However, the toilet seats 90 have many sizes and the sanitary cover of a single size cannot fit with toilet seats 90 of different sizes.

To overcome the shortcomings, the present invention tends to provide a portable self-attached sanitary cover for toilet seats to mitigate the aforementioned problems.

SUMMARY OF THE INVENTION

The main objective of the invention is to provide a portable self-attached sanitary cover for toilet seats to droop and tightly abut a toilet seat for positioning.

The technical feature of the present invention is to adopt a thicker and heavier structure design to droop to tightly abut the toilet seat 90 for secure positioning due to gravity. The concept of the present invention does not belong to the prior art, such as an improved toilet seat or the conventional sanitary covers adhering to or hooking the toilet seat. It is hard to achieve by ordinary technology extension. The present invention is inventive.

To achieve the foregoing objective, a portable self-attached sanitary cover for toilet seats is a flexible and annular pad and has an outer edge section, an inner edge section, a seat recess, a weighted section, an excreting hole and a folding gap. The seat recess is formed between the outer edge section and the inner edge section. The weighted section is mounted securely on the outer edge section. The excreting hole is formed through the portable self-attached sanitary cover and is surrounded by the inner edge section. The folding gap is formed in the portable self-attached sanitary cover. Because the portable self-attached sanitary cover has the weighted section, the outer edge section is capable of drooping to tightly abut an outer rim of a toilet seat. Accordingly, the portable self-attached sanitary cover is securely positioned on the toilet seat.

Other objects, advantages and novel features of the invention will become more apparent from the following detailed description when taken in conjunction with the accompanying drawings.

DETAILED DESCRIPTION OF PREFERRED EMBODIMENT

Figure 1:
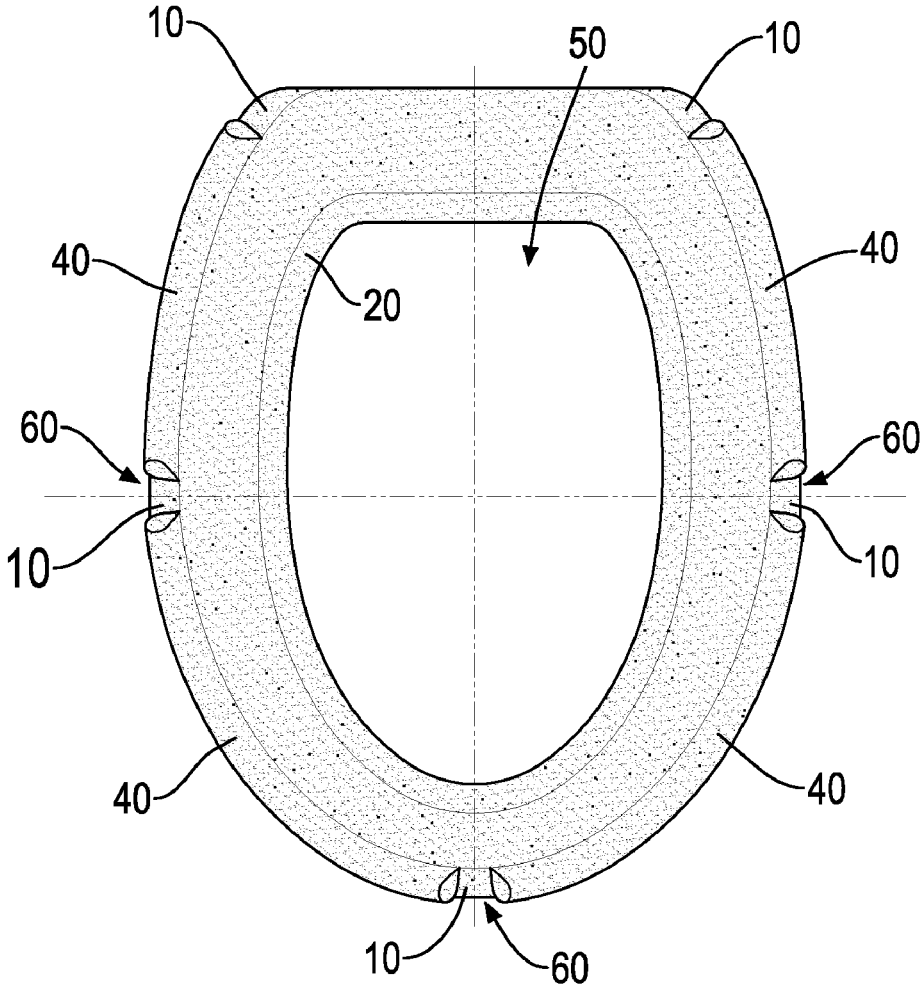
FIG. 1 is a top view of a first embodiment of the present invention showing that the portable self-attached sanitary cover is spread out.
Figure 2:
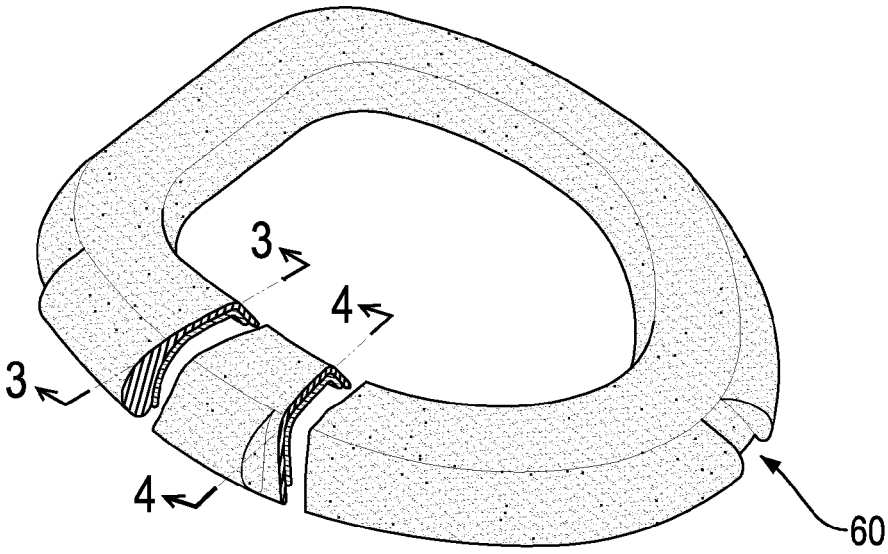
FIG. 2 is a perspective view in partial section of the present invention in FIG. 1 showing that the portable self-attached sanitary cover is placed on a top of a toilet seat.
Figure 3:
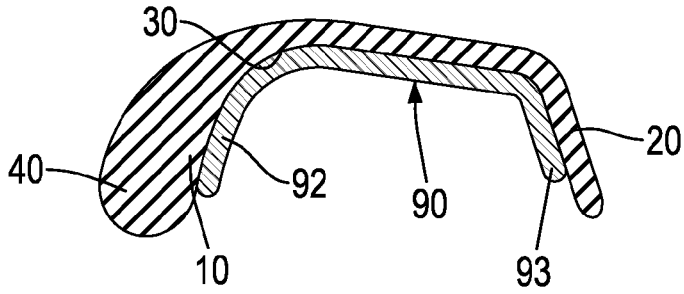
FIG. 3 is an enlarged cross sectional side view of the present invention along line 3-3 in FIG. 2 showing a weighted section.
Figure 4:
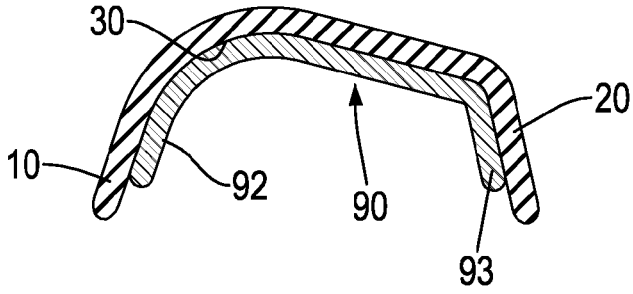
FIG. 4 is an enlarged cross sectional side view of the present invention along line 4-4 in FIG. 2.

FIG. 1 is a top view of a first embodiment of the present invention showing that a portable self-attached sanitary cover is spread out. FIG. 2 is a perspective view in partial section of the present invention in FIG. 1 showing that the portable self-attached sanitary cover is placed on a top of the toilet seat 90. FIG. 3 is an enlarged cross sectional side view of the present invention along line 3-3 in FIG. 2. FIG. 4 is an enlarged cross sectional side view of the present invention along line 4-4 in FIG. 2.

With reference to FIGS. 1 to 4, a first embodiment of the portable self-attached sanitary cover for toilet seats in accordance with the present invention is a thick, heavy, flexible and annular pad. The pad is made of polymer material, such as rubber or polyethylene. The pad is chemically stable and non-absorbent.

The portable self-attached sanitary cover comprises an outer edge section 10, an inner edge section 20, a seat recess 30, a weighted section 40, an excreting hole 50 and multiple folding gaps 60.

The outer edge section 10 is loop-shaped. Preferably, the outer edge section 10 is U-shaped.

The inner edge section 20 is loop-shaped and is surrounded by the outer edge section 10. Preferably, the inner edge section 20 is O-shaped.

The seat recess 30 is formed in the portable self-attached sanitary cover and is located between the outer edge section 10 and the inner edge section 20.

The weighted section 40 is loop-shaped and is mounted securely on the outer edge section 10. Preferably, the weighted section 40 is integrally connected with an outer surface of the outer edge section 10.

The excreting hole 50 is formed through a central area of the portable self-attached sanitary cover and is surrounded by the inner edge section 20.

Figure 5:
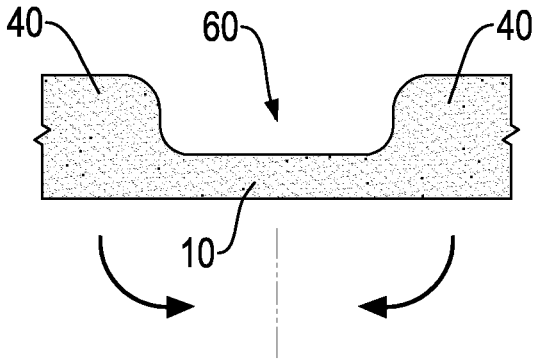
FIG. 5 is an enlarged side view of the present invention in FIG. 1 showing a folding gap.
Figure 6:
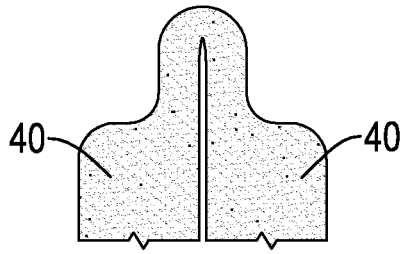
FIG. 6 is an enlarged operational view of the present invention in FIG. 5 showing the portable self-attached sanitary cover for toilet seats is folded.

With further reference to FIGS. 5 and 6, the folding gaps 60 are formed in the weighted section 40 at intervals to facilitate the portable self-attached sanitary cover to be folded. Preferably, the first embodiment of the portable self-attached sanitary cover has three folding gaps 60. The dotted lines in FIG. 1 refer to folding lines of the portable self-attached sanitary cover. Accordingly, the first embodiment is folded twice for being carried by a user.

With reference to FIGS. 2 and 3, the portable self-attached sanitary cover in accordance with the present invention covers the toilet seat 90. A shape of the seat recess 30 corresponds to that of the toilet seat 90 and the seat recess 30 encompasses the toilet seat 90. Because the weighted section 40 is securely mounted on the outer edge section 10, the outer edge section 10 droops to tightly abut an outer surface of the outer rim 92. Accordingly, the portable self-attached sanitary cover in accordance with the present invention is securely positioned on the toilet seat 90 and will not fall or slide.

FIG. 4 is an enlarged cross sectional side view of the present invention along line 4-4 in FIG. 2. FIG. 5 is an enlarged side view of the present invention in FIG. 1. FIG. 6 is an enlarged operational view of the present invention in FIG. 5 showing the portable self-attached sanitary cover for toilet seats is folded.

With reference to FIGS. 4 to 6, part of the portable self-attached sanitary cover is thin to facilitate the portable self-attached sanitary cover to be folded because the folding gaps 60 are formed in the portable self-attached sanitary cover.

In mechanics of materials, forces of tension and compression apply to part of an object when the object is bent. When a thick object is bent, the forces of tension and compression are large. The portable self-attached sanitary cover has the folding gaps 60 to partially reduce the volume of the portable self-attached sanitary cover. Accordingly, part of the portable self-attached sanitary cover becomes thin, reduces the forces of tension and compression and is easily folded.

Figure 7:
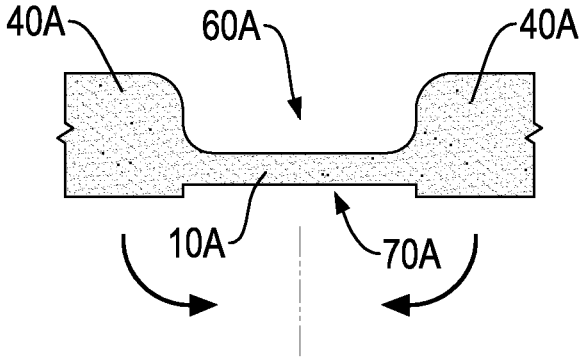
FIG. 7 is an enlarged side view of a second embodiment of the present invention showing a folding gap and an auxiliary gap.
Figure 8:
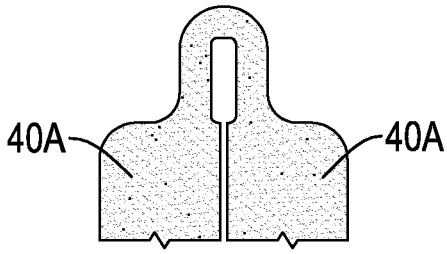
FIG. 8 is an enlarged operational view of the present invention in FIG. 7 showing the portable self-attached sanitary cover for toilet seats is folded.

FIG. 7 is an enlarged side view of a second embodiment of the present invention. FIG. 8 is an enlarged operational view of the present invention in FIG. 7 showing the portable self-attached sanitary cover for toilet seats is folded.

With reference to FIGS. 7 and 8, a second embodiment of the portable self-attached sanitary cover is substantially the same as the first embodiment. The portable self-attached sanitary cover further has multiple auxiliary gaps 70A. The auxiliary gaps 70A are formed in the outer edge section 10A and are respectively opposite to the folding gaps 60A. The auxiliary gaps 70A further facilitate the second embodiment of the portable self-attached sanitary cover to be folded.

Figure 9:
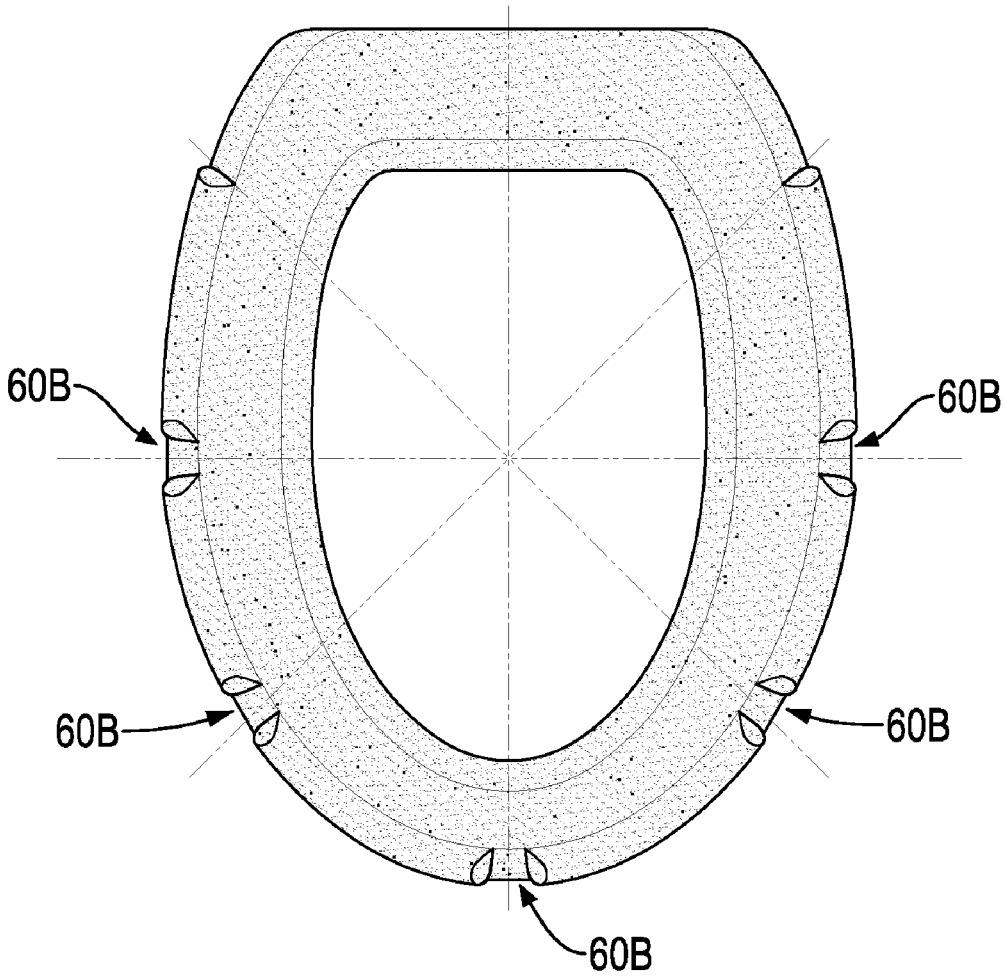
FIG. 9 is a top view of a third embodiment of the present invention showing that the portable self-attached sanitary cover is spread out.

With reference to FIG. 9, a third embodiment of the portable self-attached sanitary cover is substantially the same as the first embodiment. The portable self-attached sanitary cover has five folding gaps 60B. Accordingly, the third embodiment has to be folded in three times for being carried by a user.

Figure 10:
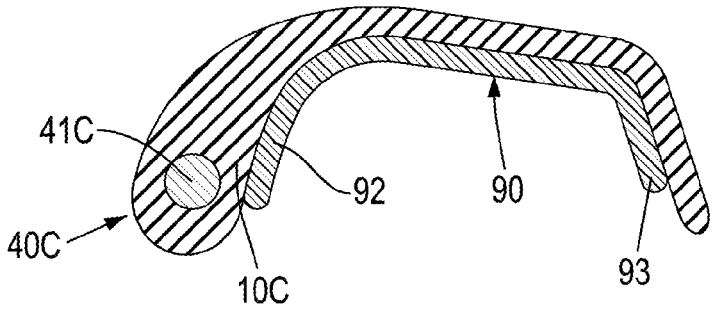
FIG. 10 is an enlarged cross sectional side view of a fourth embodiment of the present invention.
Figure 11:
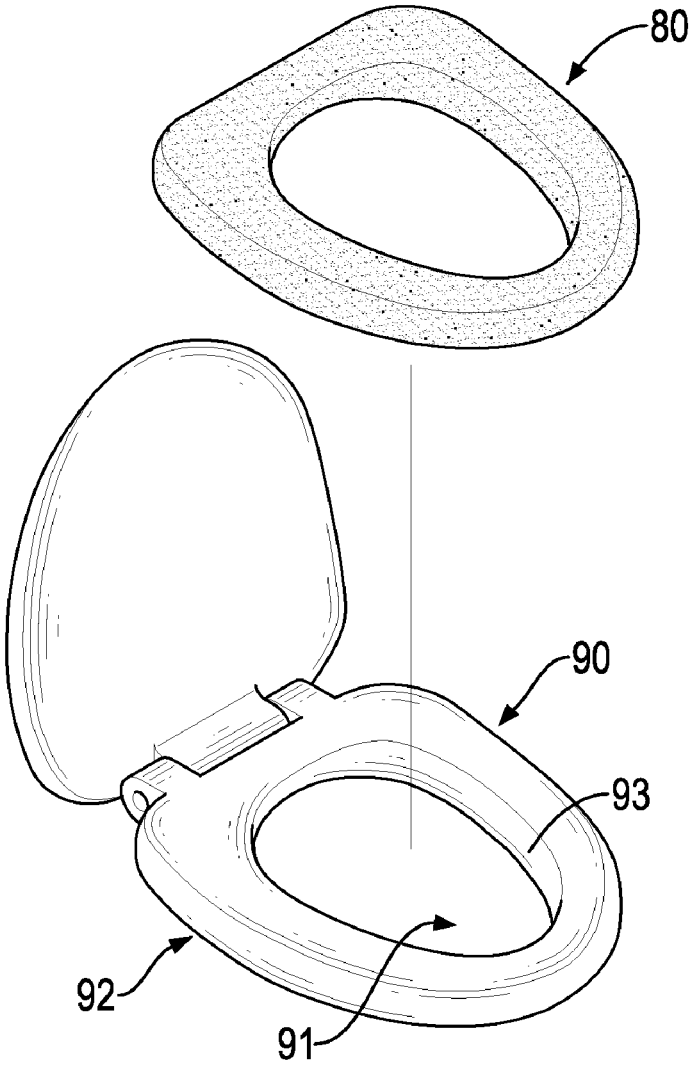
FIG.11 PRIOR ART
FIG. 11 is an exploded perspective view of a conventional toilet seat and a conventional sanitary cover in accordance with the prior art.

With reference to FIG. 10, a fourth embodiment of the portable self-attached sanitary cover is substantially the same as the first embodiment. The weighted section 40C may comprise a body and a metal rod 41C embedded in the body. The weighted section 40C is mounted securely on the outer edge section 10C. The outer edge section 10C also droops to tightly abut the outer surface of the outer rim 92.

In conclusion, the present invention tends to provide the portable self-attached sanitary cover having an essential characteristic that the portable self-attached sanitary cover has the weighted section. Accordingly, the portable self-attached sanitary cover is thicker and heavier than the conventional sanitary cover and can droop to tightly abut the toilet seat 90 for secure positioning due to gravity. The present invention does not belong to the prior art, such as an improved toilet seat or the conventional sanitary covers adhering to or hooking the toilet seat 90. Therefore, the differences between the present invention and the prior art are not obvious at the time the present invention was made to a person having ordinary skill in the art to which the present invention pertains. The present invention is inventive. Besides, the present invention can be manufactured or used in industries and the present invention is applicable. The present invention was not known or used by others in this country, or patented or described in a printed publication in this or a foreign country, before the present invention by the applicant for patent. The present invention is novel.

From the above description, it is noted that the present invention has the following advantages:

1. Easy Position:

Because the portable self-attached sanitary cover in accordance with the present invention has the weighted section 40,40C, the outer edge section 10,10C is capable of drooping to tightly abut the outer surface of the outer rim 92. Accordingly, the portable self-attached sanitary cover is securely positioned on the toilet seat 90. A shape of the portable self-attached sanitary cover is similar to a saddle and can be easily put on the toilet seat 90 for positioning.

2. Convenient Carry:

Because the portable self-attached sanitary cover in accordance with the present invention has the folding gaps 60,60A, 60B, the self-attached sanitary cover is easily folded for carrying.

3. Suitable for Toilet Seats of Similar Sizes:

The weighted section 40,40C makes the outer edge section 10,10C droop, so the soft outer edge section 10,10C can tightly abut the outer rim 92 of the toilet seat 90. Accordingly, the portable self-attached sanitary cover of a single size can fit with toilet seats 90 of similar sizes.

4. Reusable:

The portable self-attached sanitary cover in accordance with the present invention is made of polymer material, so the portable self-attached sanitary cover can be cleansed for reuse.

5. Prevention of Deformation:

Because the portable self-attached sanitary cover has the weighted section 40,40C, the portable self-attached sanitary cover is thicker and heavier than the conventional sanitary cover. Accordingly, the portable self-attached sanitary cover does not deform as easily as the conventional sanitary cover. The portable self-attached sanitary cover can remain the shape when a user sits on the portable self-attached sanitary cover.

6. Non-Absorbency:

The portable self-attached sanitary cover for toilet seats is non-absorbent for water, so the portable self-attached sanitary cover does not get wet when splashed by dirty water. Because the portable self-attached sanitary cover is non-absorbent, the portable self-attached sanitary cover does not absorb dirty water to contaminate skins of the user.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable self-attached sanitary cover for toilet seats, the portable self-attached sanitary cover being a flexible and annular pad and comprising:

a loop-shaped outer edge section;

a loop-shaped inner edge section surrounded by the outer edge section;

a seat recess formed in the portable self-attached sanitary cover and located between the outer edge section and the inner edge section;

a loop-shaped weighted section mounted securely on the outer edge section;

an excreting hole formed through a central area of the portable self-attached sanitary cover and surrounded by the inner edge section; and a folding gap formed in the portable self-attached sanitary cover to facilitate the portable self-attached sanitary cover to be folded.

2. The portable self-attached sanitary cover for toilet seats as claimed in claim 1, wherein the weighted section is integrally connected with an outer surface of the outer edge section.

3. The portable self-attached sanitary cover for toilet seats as claimed in claim 2, wherein the portable self-attached sanitary cover has multiple folding gaps formed in the weighted section at intervals to facilitate the portable self-attached sanitary cover to be folded.

4. The portable self-attached sanitary cover for toilet seats as claimed in claim 3, wherein portable self-attached sanitary cover further has multiple auxiliary gaps; and the auxiliary gaps are formed in the outer edge section and are respectively opposite to the folding gaps to facilitate the portable self-attached sanitary cover to be folded.

5. The portable self-attached sanitary cover for toilet seats as claimed in claim 2, wherein the portable self-attached sanitary cover has three folding gaps.

6. The portable self-attached sanitary cover for toilet seats as claimed in claim 2, wherein the portable self-attached sanitary cover has five folding gaps.

7. The portable self-attached sanitary cover for toilet seats as claimed in claim 2, wherein the weighted section has a body and a metal rod embedded in the body.

* * * * *